US007847473B2

(12) United States Patent
Suzuki

(10) Patent No.: US 7,847,473 B2
(45) Date of Patent: Dec. 7, 2010

(54) SPARK PLUG

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 567 days.

(21) Appl. No.: 11/727,968

(22) Filed: Mar. 29, 2007

(65) Prior Publication Data

US 2008/0174223 A1 Jul. 24, 2008

Related U.S. Application Data

(60) Provisional application No. 60/885,783, filed on Jan. 19, 2007.

(51) Int. Cl.
*H01T 13/08* (2006.01)
*H01T 13/00* (2006.01)

(52) U.S. Cl. ..... 313/143; 313/144

(58) Field of Classification Search ..... 313/143, 313/144; 123/608
See application file for complete search history.

(56) References Cited

U.S. PATENT DOCUMENTS

| | | | | |
|---|---|---|---|---|
| 2,308,968 | A * | 1/1943 | Gregory | 219/149 |
| 6,111,345 | A | 8/2000 | Shibata et al. | |
| 6,310,430 | B1 | 10/2001 | Moriya | |
| 6,414,420 | B1 * | 7/2002 | Suzuki | 313/144 |
| 6,741,015 | B2 * | 5/2004 | Suzuki et al. | 313/143 |
| 2005/0017622 | A1 * | 1/2005 | Tamura | 313/143 |
| 2006/0022566 | A1 * | 2/2006 | Ishiguro | 313/143 |

FOREIGN PATENT DOCUMENTS

| | | | |
|---|---|---|---|
| JP | 10-125444 | A | 5/1998 |
| JP | 11-219772 | A | 8/1999 |
| JP | 11-273827 | A | 10/1999 |
| JP | 2000-215964 | A | 8/2000 |
| JP | 2002-164147 | A | 6/2002 |
| JP | 2006-92955 | A | 4/2006 |

OTHER PUBLICATIONS

"AISI 1005, 1006, 1008", Engineering Properties of Steel, ASM International, 1982.*
"AISI 1017", Alloy Digest, Alloy Digest, Inc., Jan. 1986.*
"AISI 1023, 1025, 1026", Engineering Properties of Steel, ASM International, 1982.*
"AISI 1017", Alloy Digest, Alloy Digest Inc., Jan. 1986.*

* cited by examiner

*Primary Examiner*—Bumsuk Won
*Assistant Examiner*—Nathaniel J Lee
(74) *Attorney, Agent, or Firm*—Sughrue Mion, PLLC

(57) ABSTRACT

A spark plug in which a distal end portion (60) of a crimp portion (53) of a metallic shell (50) is crimped by bending the distal end portion inward, whereby the metallic shell (50) and an insulator (10) are fixed together with a first packing (6), a second packing (7), and talc (9) being present therebetween. The first packing (6) assumes an annular shape and has a circular cross section. A minimum diameter portion of the crimp portion (53), which portion is closest to the outer circumferential surface (17) of a trunk portion (18), is located at the position of the center line of the first packing (6) or inward thereof with respect to the axis O. The crimp portion (53) does not come into contact with the insulator (10), and the first packing (6) comes into contact with the insulator (10). Furthermore, the first packing (6) has a hardness that is lower than that of the crimp portion (53).

14 Claims, 8 Drawing Sheets

SPARK PLUG

CROSS REFERENCE TO RELATED APPLICATIONS

This application claims benefit of U.S. Provisional Application No. 60/885,783 filed Jan. 19, 2007, incorporated herein by reference in its entirety.

BACKGROUND OF THE INVENTION

1. Field of the Invention

The present invention relates to a spark plug in which a metallic shell is crimped for integral fixing of the metallic shell and an insulator.

2. Description of the Related Art

Conventionally, an internal combustion engine uses a spark plug for ignition. An ordinary spark plug includes a metallic shell which holds an insulator into which a center electrode is inserted, and a ground electrode welded to a front end portion of the metallic shell. Furthermore, the other end portion of the ground electrode and a front end portion of the center electrode face each other to thereby form a spark discharge gap. Thus, spark discharge is generated between the center electrode and the ground electrode.

In such a spark plug, a crimp portion provided at the rear end of the metallic shell is crimped with a step portion formed on an outer circumferential surface of the insulator held by means of a step portion formed on an inner circumferential surface of the metallic shell, whereby the insulator and the metallic shell are integrally fixed to one another. Talc and a packing are accommodated in the interior of the crimp portion. In order to reliably fix the metallic shell and the insulator together, an end of the crimp portion is brought into contact with the insulator.

In recent years, implementation of improved output and low fuel consumption have been required of automobile engines. Under such circumstances, in order to ensure the requisite degree of freedom in designing engines, there has been a need for a reduction in spark plug diameter and an increase in reach. As a result, the outer diameter of a trunk portion of the insulators has been reduced, with a resultant decrease in strength.

In the case where such a small-diameter spark plug is configured such that the crimp portion is in direct contact with the insulator, if the insulator is subjected to an external impact; for example, as a result of a spark plug mounting tool, such as a wrench, striking the insulator when the spark plug is being mounted to an engine, the insulator may be damaged or fractured at the end of the crimp portion in contact with the trunk portion. In order to prevent such fracture of the insulator, the insulator and the metallic shell are desirably fixed together so that the end of the crimp portion of the metallic shell does not come into contact with the trunk portion of the insulator (refer to, for example, Patent Document 1).

[Patent Document 1] Japanese Patent Application Laid-Open (kokai) No. H10-125444.

PROBLEMS TO BE SOLVED BY THE INVENTION

However, in the case where the insulator and the metallic shell are fixed together so that a clearance is formed between the end of the crimp portion and the trunk portion of the insulator, when subjected to an external impact, the insulator deflects in relation to the axis of the spark plug. This is because the crimp portion cannot support the insulator. As a result, the trunk of the insulator possibly comes into contact with the end of the crimp portion. Further, in the case where a larger clearance is provided between the end of the crimp portion and the trunk portion of the insulator in order to prevent these parts from coming into contact even when the insulator is deflected, in some cases, airtightness between the metallic shell and the insulator cannot be maintained even after crimping is performed. When a packing is disposed between the metallic shell and the insulator so as to maintain airtightness, a problem arises in that the insulator possibly fractures at the position of the packing.

SUMMARY OF THE INVENTION

The present invention has been achieved in order to solve the above-described problems, and an object thereof is to provide a spark plug in which the insulator is not susceptible to fracture when subjected to an external impact.

The above object of the present invention has been achieved by providing (1) a spark plug comprising a rod-shaped center electrode having an electrode for spark discharge at a front end thereof, an insulator which has an axial hole extending along the direction of an axis of the center electrode and which holds the center electrode in the axial hole; a metallic shell surrounding the insulator, the metallic shell holding a trunk portion of the insulator by a crimp portion provided at a rear end of the metallic shell in a state in which the insulator engages a step portion formed on an inner circumferential surface of the metallic shell; and an annular first packing disposed between an inner circumferential surface of the crimp portion and an outer circumferential surface of the trunk portion, wherein the following relationship is satisfied:

$$(G+L)/2 \geqq d > L$$

where G represents an outer diameter in millimeters of the first packing, L represents an inner diameter in millimeters of the first packing, d represents an inner diameter in millimeters of a minimum diameter portion of the crimp portion, and wherein the following relationship is satisfied:

$$N < M$$

where M represents a hardness in Hv of the crimp portion, and N represents a hardness in Hv of the first packing.

In addition to having the configuration of the invention according to (1) above, in a preferred embodiment (2), the spark plug is characterized in that the metallic shell has a tool engagement portion on an outer circumferential surface thereof, and the relationship $E-G \geqq 0.1$ (mm) is satisfied, where E represents a diameter in millimeters of a portion of the inner circumferential surface of the metallic shell corresponding to the tool engagement portion.

In addition to having the configuration of the invention according to (1) or (2) above, in a preferred embodiment (3), the spark plug is characterized in that the relationship $J \leqq 60$ ($mm^2$) is satisfied, where J represents an area of a cross section of the insulator perpendicular to the axis thereof measured at a minimum diameter portion of the crimp portion.

In addition to having the configuration of the invention according to any one of (1) to (3) above, in a preferred embodiment (4), the spark plug is characterized in that the insulator has a flange portion located frontward of the trunk portion, and wherein talc is charged in a sealed condition in a clearance formed between the outer circumferential surface of the trunk portion of the insulator and the inner circumferential surface of the metallic shell, said clearance extending frontward from the inner circumferential surface of the crimp portion to the flange portion of the insulator.

EFFECTS OF THE INVENTION

In the spark plug of the invention according to (1) above, the metallic shell and the insulator are integrated through crimping performed in a state in which the annular first packing is disposed between the inner circumferential surface of the crimp portion and the outer circumferential surface of the trunk portion of the insulator. The outer diameter G and the inner diameter L of the first packing and the inner diameter d of the minimum diameter portion of the crimp portion satisfy the relationship $(G+L)/2 \geqq d > L$. Thus, it becomes possible to enhance the sealing property by means of the first packing and to prevent the crimp portion from contacting the insulator. In this manner, fracturing of the insulator is prevented at the position of the crimp portion, which fracturing would otherwise occur when subjected to an external impact.

When the above-described configuration is employed, the first packing comes into contact with the insulator, but the crimp portion does not come into contact with the insulator. However, in the present invention, the hardness of the first packing is set so as to be lower than that of the crimp portion in order to prevent the insulator from fracturing at the position of the first packing, which fracture would otherwise occur when subjected to an external impact. In this manner, when the insulator is subjected to an external impact, the first packing serves as a cushioning material and absorbs the impact, whereby fracture of the insulator can be prevented. Preferably, the difference in hardness falls within a range of $20 \leqq M-N \leqq 80$ (Hv).

The spark plug of the invention according to (2) has the following effect in addition to the effect of the invention according to (1) above. Since the difference between the diameter E of the inner circumferential surface of the metallic shell and the outer diameter G of the first packing is 0.1 mm or greater, a loose fit or play is provided between the first packing and the inner circumferential surface of the metallic shell. Therefore, when the insulator is subjected to external impact, the first packing absorbs the impact while slightly changing its position. Accordingly, the fracture resistance can be improved. The difference between the diameter E of the inner circumferential surface of the metallic shell and the outer diameter G of the first packing is set to 1.0 mm or less, more preferably, 0.7 mm or less.

The spark plug of the invention according to (3) has the following effect in addition to the effect of the invention according to (1) or (2) above. Since the present invention is applied to a spark plug including an insulator formed such that the area J of a cross section of the insulator perpendicular to the axis thereof is 60 $mm^2$ or less, the effect of improving fracture resistance (i.e., preventing the hard crimp portion from coming into direct contact with the insulator) and the effect of absorbing an external impact can be attained sufficiently.

The spark plug of the invention according to (4) has the following effect in addition to the effect of the invention according to any one of (1) to (3) above. In this embodiment, the spark plug is characterized in that the insulator has a flange portion located frontward of the trunk portion, and wherein talc is charged in a sealed condition in a clearance formed between the outer circumferential surface of the trunk portion of the insulator and the inner circumferential surface of the metallic shell, said clearance extending frontward from the inner circumferential surface of the crimp portion to the flange portion of the insulator. Accordingly, the first packing present between the two members can be positioned, and the talc serves as a cushioning member when the insulator is subjected to an external impact, whereby the fracture resistance of the insulator can be improved.

DESCRIPTION OF REFERENCE NUMERALS

Figure 1:
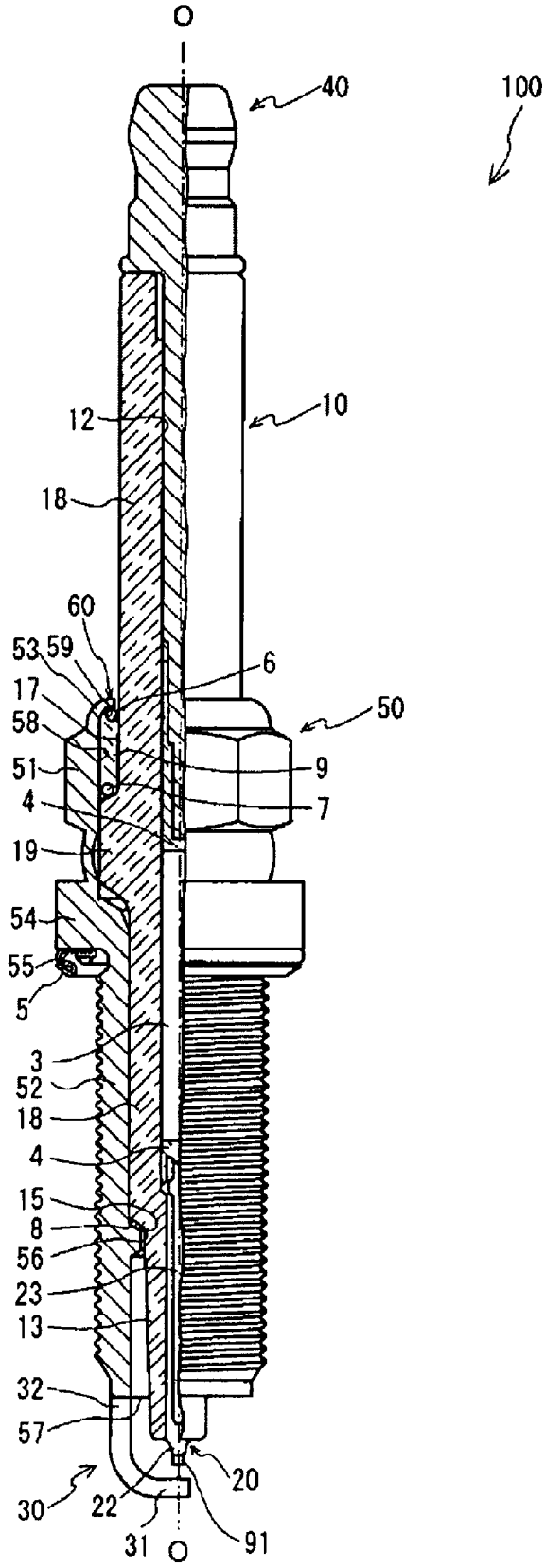
FIG. 1 is a partial sectional view of a spark plug 100.

Reference numerals used to identify various structural features in the drawings include the following.

6: first packing
9: talc
10: insulator
12: axial hole
17: outer circumferential surface
18: trunk portion
20: center electrode
50: metallic shell
51: tool engagement portion
53: crimp portion
56: stepped portion
58, 59: inner circumferential surface
100: spark plug

BEST MODE FOR CARRYING OUT THE INVENTION

An embodiment of the present invention will next be described with reference to the drawings. However, the present invention should not be construed as being limited thereto.

First, the structure of a spark plug 100, which is an exemplary spark plug according to the present embodiment, will be described with reference to FIG. 1. FIG. 1 is a partial sectional view of the spark plug 100. In FIG. 1, the direction of an axis O of the spark plug 100 is referred to as the vertical direction. In the following description, the lower side of the spark plug 100 in FIG. 1 is referred to as the front end side of the spark plug 100, and the upper side as the rear end side.

As shown in FIG. 1, the spark plug 100 includes an insulator 10 constituting an insulating body; a metallic shell 50 which holds the insulator 10; a center electrode 20 which is held in the insulator 10 in the direction of the axis O; a ground electrode 30 whose proximal end portion 32 is welded to a front end face 57 of the metallic shell 50 and one side surface of whose distal end portion 31 faces a front end portion 22 of the center electrode 20; and a metallic terminal member 40 provided at a rear end portion of the insulator 10.

First, the insulator 10 of the spark plug 100 will be described. As is well known, the insulator 10 is formed by firing from alumina or the like and has a tubular shape having an axial hole 12 extending in the direction of the axis O at the center thereof. At an approximate center of a trunk portion 18 of the insulator 10, a flange portion 19 which is greater in diameter than the trunk portion 18 is formed. Further, a leg portion 13 is formed frontward (towards the lower side in FIG. 1) of the trunk portion 18. The leg portion 13 is smaller in outer diameter than the trunk portion 18, and is exposed to a combustion chamber of an internal combustion engine. A step portion 15 is formed between the leg portion 13 and the trunk portion 18.

The center electrode 20 is formed from a nickel alloy, such as INCONEL™ 600 or 601, or the like and has therein a metallic core 23 formed from copper or the like having excellent thermal conductivity. The front end portion 22 of the center electrode 20 projects from the front end face of the insulator 10 and is formed such that the diameter thereof reduces toward the front end side. In order to improve resistance to spark-induced consumption, a chip 91 formed from a noble metal is joined to the front end face of the front end portion 22. The center electrode 20 is electrically connected to the metallic terminal member 40 located above, via a sealing material 4 and a ceramic resistor 3, which are provided in the axial hole 12. A high-voltage cable (not shown) is connected to the metallic terminal member 40 via a plug cap (not shown) for applying high voltage thereto.

Next, the ground electrode 30 will be described. The ground electrode 30 is formed from a metal having high corrosion resistance; for example, a nickel alloy, such as INCONEL™ 600 or 601. The ground electrode 30 has a generally rectangular cross section perpendicular to the longitudinal direction thereof. The proximal end portion 32 of the ground electrode 30 is welded to the front end face 57 of the metallic shell 50. The distal end portion 31 of the ground electrode 30 is bent such that one side surface thereof faces the front end portion 22 of the center electrode 20.

Moreover, a noble metal chip is joined, by means of laser welding, to the ground electrode 31, at a position facing the chip 91. The noble metal chip is preferably a circular columnar chip which is formed of an Ir alloy, a Pt alloy, or the like and which has a projection height of 0.5 to 0.9 mm and a diameter of 0.5 to 1.0 mm. However, other known noble metal chips can be freely used.

Next, the metallic shell 50 will be described. The metallic shell 50 is a cylindrical, metallic member for fixing the spark plug 100 to the engine head of the unillustrated internal combustion engine. The metallic shell 50 holds the insulator 10 therein while surrounding the same. The metallic shell 50 is formed from an iron-based material and includes a tool engagement portion 51 with which an unillustrated spark plug wrench is engaged, and a male thread portion 52 which is screwed into the engine head provided at an upper portion of the unillustrated internal combustion engine. A crimp portion 53 is formed rearward of the tool engagement portion 51, and an inner circumferential surface 59 of the crimp portion 53 is formed to be continuous with an inner circumferential surface 58 of the tool engagement portion 51.

When crimping is performed to bend a distal end portion 60 of the crimp portion 53 of the metallic shell 50 inward, the step portion 15 of the insulator 10 is supported, via a plate packing 8, on a step portion 56 formed within the metallic shell 50, whereby the metallic shell 50 and the insulator 10 are integrated. In order to complete the crimping seal, annular first and second packings 6 and 7 each having a circular cross section are respectively disposed between the inner circumferential surface 59 of the crimp portion 53 of the metallic shell 50 and an outer circumferential surface 17 of the trunk portion 18 of the insulator 10 and between the inner circumferential surface 58 of the tool engagement portion 51 and the outer circumferential surface 17 of the trunk portion 18. Further, talc powder 9 is charged between the first and second packings 6 and 7. That is, the metallic shell 50 holds the insulator 10 via the plate packing 8, the first packing 6, the second packing 7, and the talc 9. The first and second packings 6 and 7 are formed, from a metallic material such as soft iron or copper, into an annular shape to have a circular cross section. Moreover, a flange portion 54 is formed between the tool engagement portion 51 and the male thread portion 52, and a gasket 5 is fitted onto the metallic shell 50 to be located at the vicinity of the rear end of the male thread portion 52; that is, on a seat surface 55 of the flange portion 54.

Figure 2:
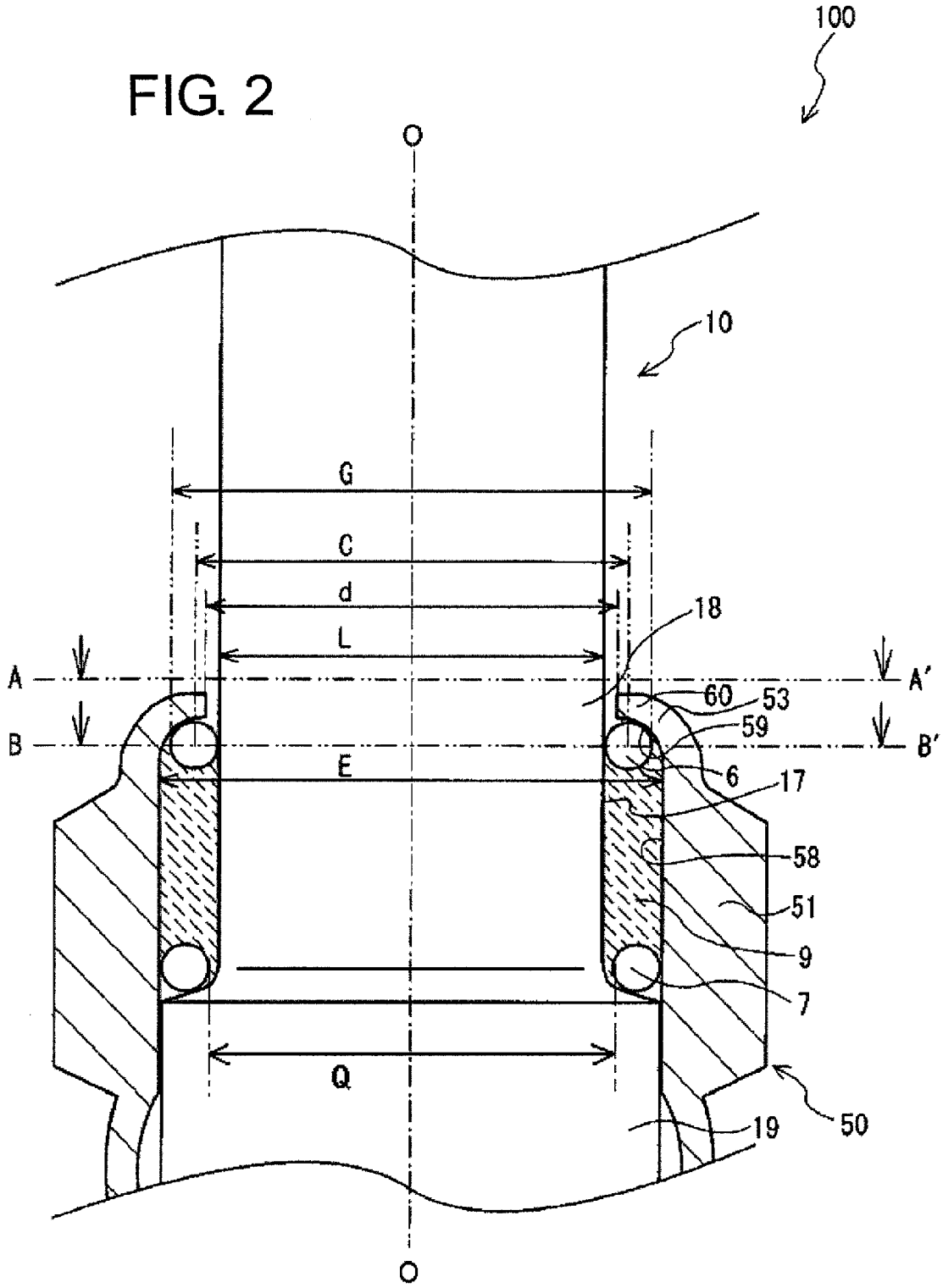
FIG. 2 is an enlarged partial sectional view of a main portion showing the vicinity of the crimp portion 53 of the metallic shell 50 of the spark plug 100.
Figure 3:
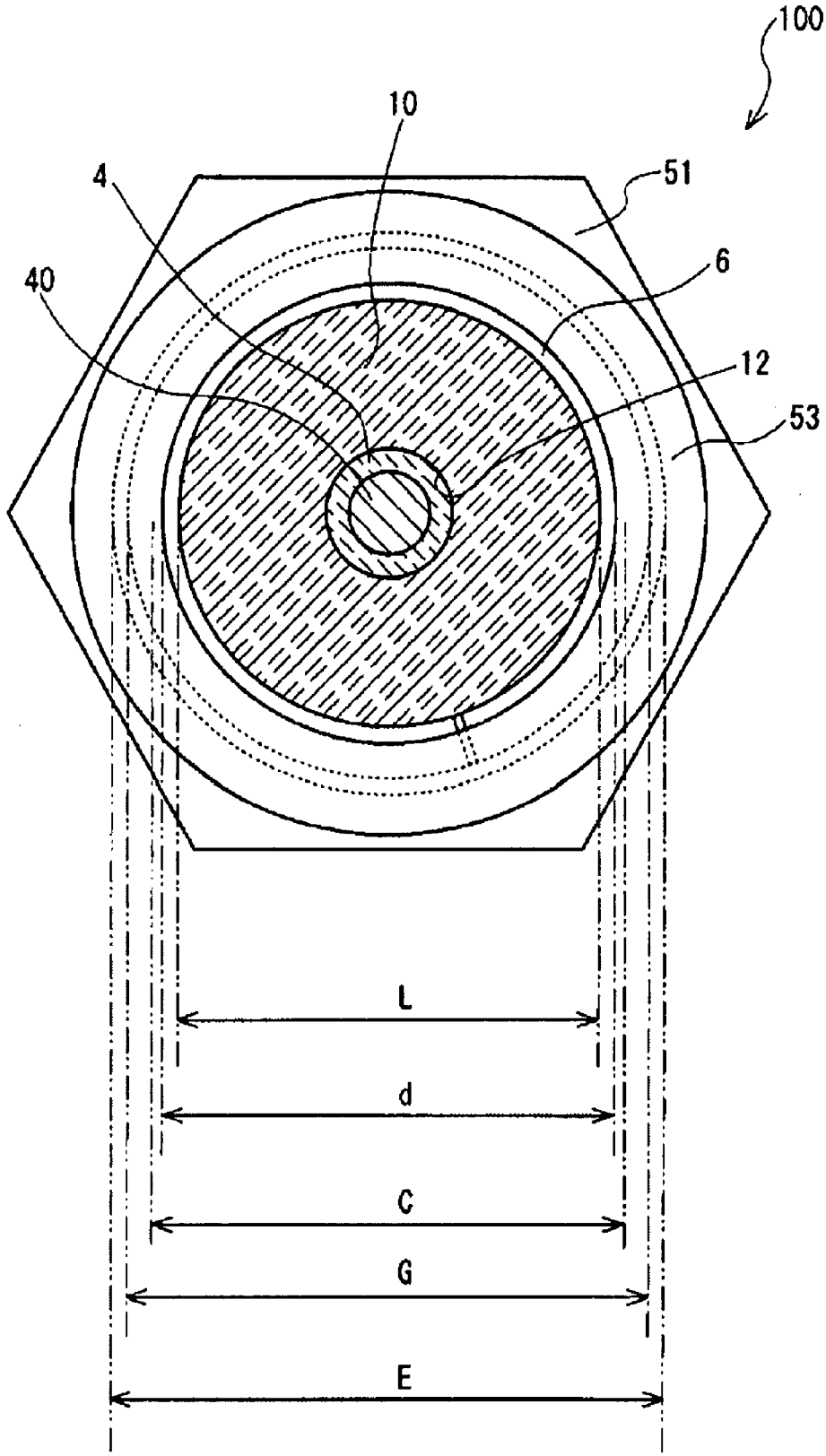
FIG. 3 is a sectional view of the spark plug 100 taken along the two-dot chain line A-A' in FIG. 2.
Figure 4:
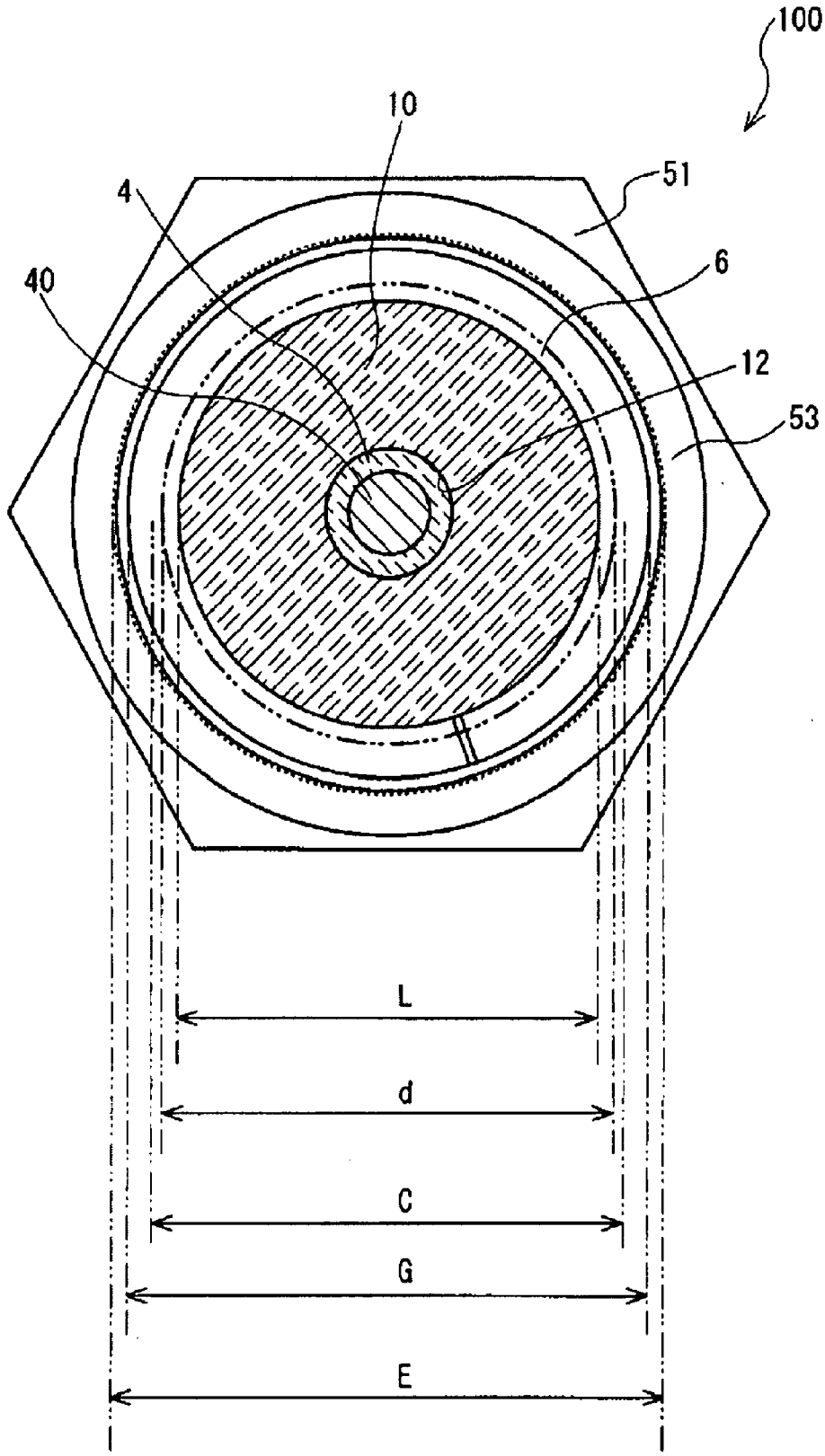
FIG. 4 is a sectional view of the spark plug 100 taken along the two-dot chain line B-B' in FIG. 2.

In the spark plug 100 of the present embodiment having the above-described structure, the positional relationship between the crimp portion 53 and the trunk portion 18 is set such that the distal end 60 of the crimp portion 53 of the metallic shell 50 does not come into contact with the outer circumferential surface 17 of the trunk portion 18 of the insulator 10. The positional relationship among the relevant portions will be described with reference to FIGS. 2 to 4. FIG. 2 is an enlarged partial sectional view of a main portion showing the vicinity of the crimp portion 53 of the metallic shell 50 of the spark plug 100. FIG. 3 is a sectional view of the spark plug 100 taken along the two-dot chain line A-A' of FIG. 2. FIG. 4 is a sectional view of the spark plug 100 taken along the two-dot chain line B-B' of FIG. 2.

In the following description, as shown in FIGS. 2 to 4, the outer diameter of the trunk portion 18 of the insulator 10; i.e., the inner diameter of the first packing 6 which comes into contact with the trunk portion 18, is represented by L (mm), and the outer diameter of the first packing 6 is represented by G (mm). When the diameter of the line (center line) passing through the center of the annular first packing 6 having a circular cross section is represented by C (mm), then $C=(G+L)/2$ (mm). The inner diameter of the distal end portion 60 of the crimp portion 53 bent toward the trunk portion 18 measured at a portion (minimum diameter portion) closest to the outer circumferential surface 17 of the trunk portion 18 is represented by d (mm). Further, the diameter of the inner circumferential surface 58 of the tool engagement portion 51, continuously extending from the inner circumferential surface 59 of the crimp portion 53 toward the front end of the metallic shell 50, is represented by E (mm). Notably, the diameter of the inner circumferential surface 59 of the crimp portion 53 before being bent by crimping is equal to the diameter E of the inner circumferential surface 58. This is because the inner circumferential surface 59 is continuous with the inner circumferential surface 58 of the tool engagement portion 51. That is, on the inner circumferential surface 59 of the crimp portion 53, a starting point of the portion bent by crimping serves as a reference for determining the diameter E.

In the present embodiment, the inner diameter L of the first packing 6 and the inner diameter d of the minimum diameter portion of the crimp portion 53 are determined such that the relationship d>L is satisfied, so as to prevent the minimum diameter portion of the crimp portion 53 from coming into contact with the outer circumferential surface 17 of the trunk portion 18 of the insulator 10. The crimp portion 53 is crimped with the talc 9 charged between the first packing 6 and the second packing 7 so as to provide a seal between the insulator 10 and the metallic shell 50. Thus, the first packing 6 covers and closes the talc-charged space at the distal end portion 60 of the crimp portion 53 so as to prevent talc 9 from leaking. In order to enhance the sealing provided by the first packing 6, the inner diameter d of the minimum diameter portion of the crimp portion 53 and the diameter C of the center line of the first packing 6 preferably satisfy the relationship C≧d. That is, when the minimum diameter portion of the crimp portion 53 and the first packing 6 are viewed from above as in FIG. 3, the minimum diameter portion of the crimp portion 53 is desirably located at the same position as the center line of the first packing 6 or between the center line and the trunk portion 18 of the insulator 10, and is separated from the trunk portion 18.

Moreover, preferably, the relationship (G+L)/2−(G−L)/4≧d is satisfied.

As a result of crimping, the first packing 6 comes into contact with the trunk portion 18 of the insulator 10. If the first packing 6 has a high hardness, the insulator 10 may fracture at the position of the first packing 6 upon external impact. In order to prevent such fracture, the hardness N (Hv) of the first packing 6 and the hardness of the metallic shell 50; particularly, the hardness M (Hv) of the crimp portion 53, are desirably set to satisfy the relationship N<M (hardness is represented by Vickers hardness Hv). The effect of improving the fracture resistance by specifying the hardness of the first packing 6 was confirmed by Example 1, described below. Further, when the hardness of the second packing 7 is represented by P (Hv), desirably, the relationship N<P<M is satisfied. When the hardness P of the second packing 7 is made smaller than the hardness M of the crimp portion 53, the crimp portion 53 can be formed in a state in which a sufficiently large pressure is applied to the talc 9. Preferably, the difference in hardness between the second packing 7 and the crimp portion 53 falls with a range of 80≧M−P≧40 (Hv). Harmful deformation of the second packing 7 is not preferred, from the viewpoint of suppressing eccentricity produced at the time of assembly. Therefore, in some cases, the second packing 7 is desirably made harder than the first packing 6. Preferably, the difference in hardness between the first packing 6 and the second packing 7 falls with a range of 30≧P−N>0 (Hv). The second packing 7 preferably has a hardness of 100 to 160 (Hv).

The fracture resistance of the insulator 10 can be improved by providing a certain degree of play between the first packing 6 and the inner circumferential surface 59 of the crimp portion 53. For such a purpose, the difference (play) between the diameter E of the inner circumferential surface 58 of the tool engagement portion 51 and the outer diameter G of the first packing 6 desirably satisfies the relationship E−G≧0.1 (mm). By crimping, the inner circumferential surface 59 of the crimp portion 53 is deformed to have an arcuate cross section. Since the first packing 6 has a circular cross section and an annular shape, the above-mentioned play is introduced by imparting a difference between the diameter E of the inner circumferential surface 58 of the tool engagement portion 51 and the outer diameter G of the first packing 6. In that case, when the insulator b is subjected to an external impact, the first packing 6 slightly changes its position and absorbs the impact. Therefore, the fracture resistance of the insulator 10 can be improved. Moreover, since the talc 9 is charged between the two packings, the effects of fixing the position of the first packing 6 and absorbing the impact by the talc 9, which has a lower hardness than the first packing 6, can be expected. The effect of improving the fracture resistance of the insulator by introducing such play was confirmed by Example 2, described below.

Further, the second packing 7, which is disposed outside in relation to the first packing 6, preferably satisfies the relationship 1.0 (mm)≧Q−L≧0.1 (mm), where Q represents the inner diameter (mm) of the second packing 7. As a result, a play or clearance of 0.1 mm to 1.0 mm is introduced between the inner circumferential surface of the second packing 7 and the trunk portion 18 of the insulator 10, and talc is charged in the clearance. Thus, the second packing is pressed forward and outward, so that is can effectively seal the talc. In order to obtain a tighter seal as described above, preferably, the relationship Q−L>E−G (mm) is satisfied. Specifically, the thickness of the second packing 7 in the radial direction is preferably made slightly smaller than that of the first packing.

When the area of a cross section of the insulator 10 perpendicular to the direction of the axis thereof (hereinafter referred to as "axial cross section") is represented by J ($mm^2$), the relationship J≦60 ($mm^2$) is desirably satisfied. In the case where the area of the axial cross section of the insulator 10 is greater than 60 $mm^2$, the insulator 10 may have a large outer diameter. When the insulator 10 has a large outer diameter, the insulator 10 has a high fracture resistance, and it is hardly susceptible to fracture even when a structure is employed in which the minimum diameter portion of the crimp portion 53 is in contact with the trunk portion 18. This was confirmed by Example 3, described below. That is, when the present invention is applied to an insulator 10 having a small diameter, the effects attained by the structure according to the present invention become remarkable. Notably, the location for measuring the axial cross section is freely determined in a region which corresponds to the distal end portion 60 of the crimp portion 53.

Figure 5:
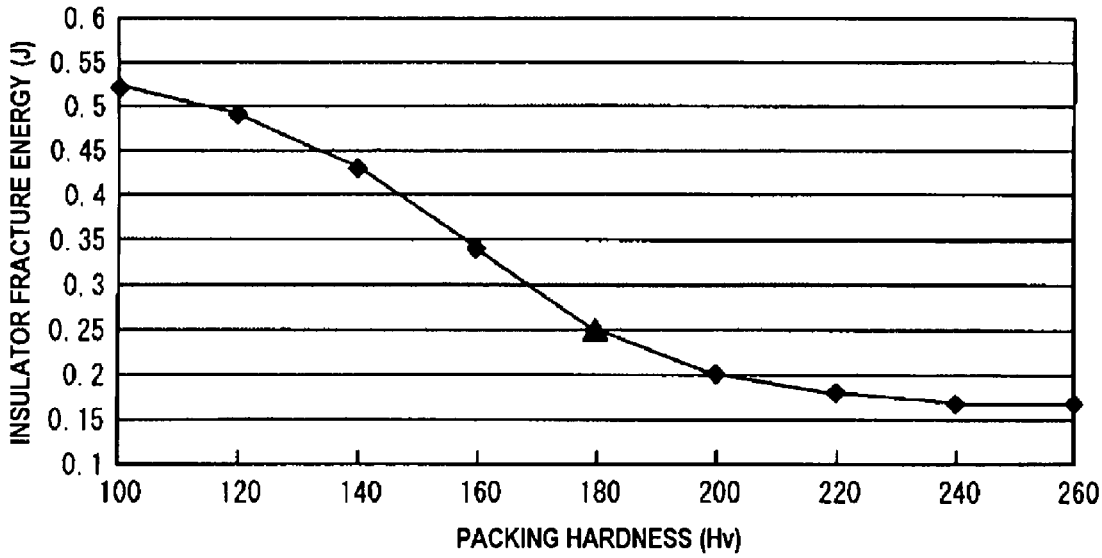
FIG. 5 is a graph showing the relationship between the hardness of the packing and fracture energy at which the insulator fractures.
Figure 6:
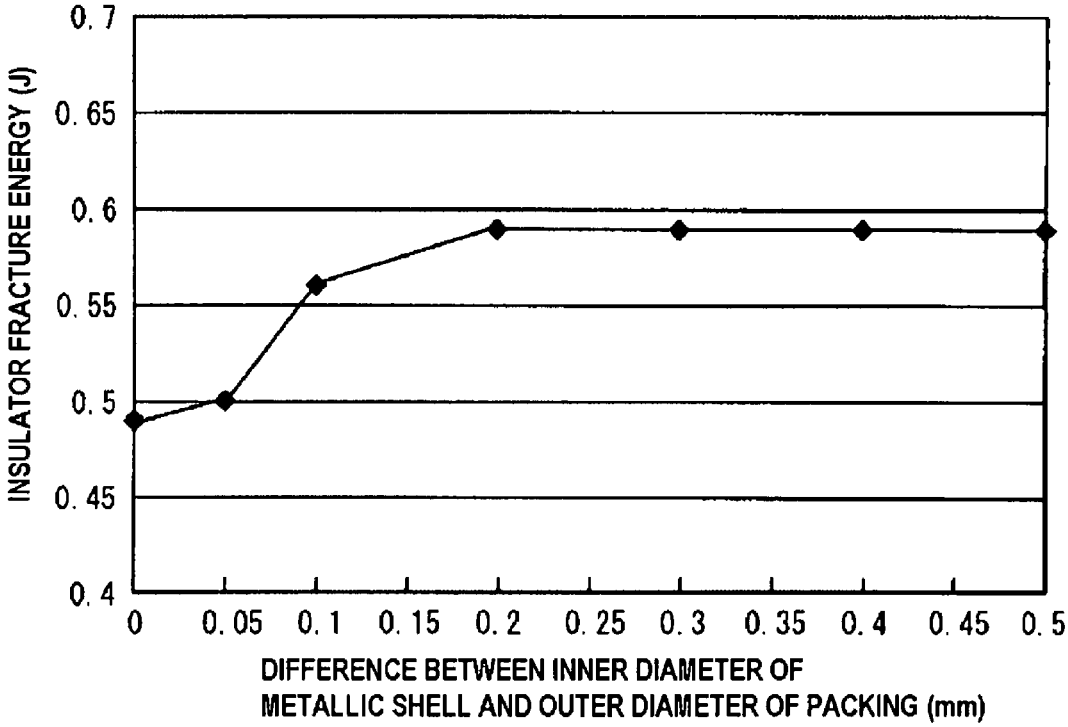
FIG. 6 is a graph showing the relationship between (i) the difference between the diameter of the inner circumferential surface of the metallic shell and the outer diameter of the packing, and (ii) the fracture energy at which the insulator fractures.
Figure 7:
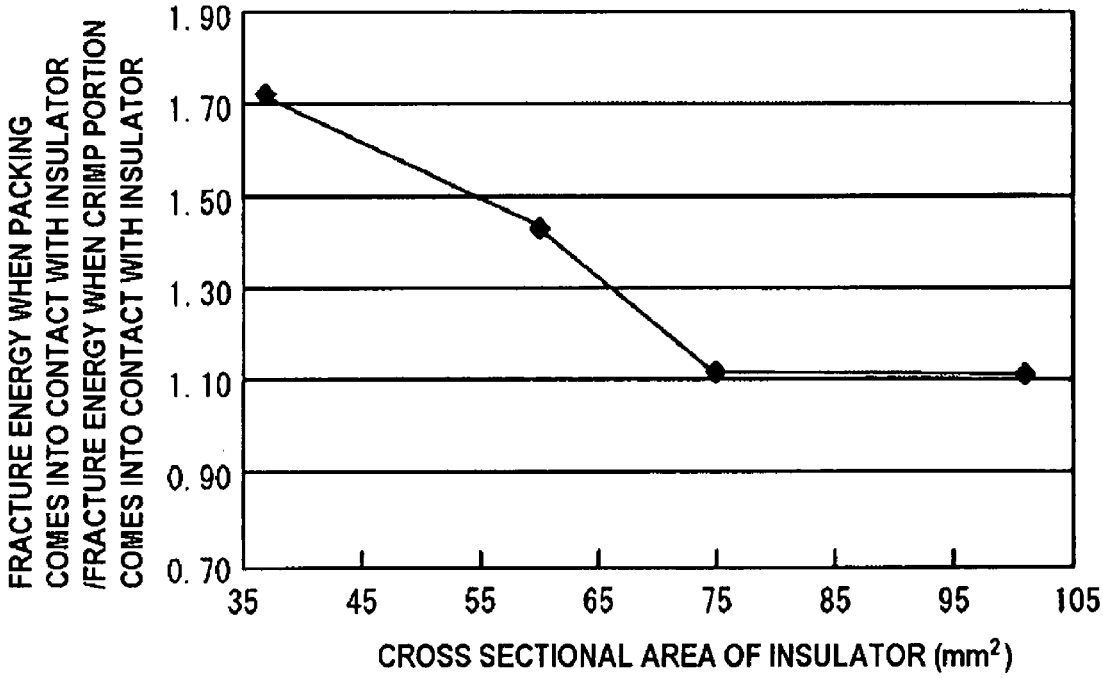
FIG. 7 is a graph showing the relationship between (i) the area of the axial cross section of the trunk portion of the insulator, and (ii) the ratio in insulator fracture energy between the case where the packing is provided and between the case where the packing is not provided.

In order to confirm the effects of the present invention, the tests shown in Examples 1 to 3 were carried out for the spark plug configured as described above. Examples 1 to 3 will be described with reference to FIGS. 5 to 7. FIG. 5 is a graph showing the relationship between the hardness of the first packing and the fracture energy at which the insulator fractures (hereinafter also referred to as "insulator fracture energy"). FIG. 6 is a graph showing the fracture energy (J) at which the insulator fractures as a function of the difference between the diameter of the inner circumferential surface of the metallic shell and the outer diameter of the first packing. FIG. 7 is a graph showing the relationship between the area of the axial cross section of the trunk portion of the insulator and the ratio in insulator fracture energy between the case where the packing is provided and the case where the packing is not provided.

In Examples 1 to 3, the fracture energy at which the insulator fractures was measured by a known Charpy test. The Charpy test is generally described below. A spark plug is oriented such that the axis O of the spark plug extends vertically and the portion containing the spark discharge gap; i.e., the front portion, is directed downward, and is fixed to a test stand by screwing the male thread portion of the metallic shell into a threaded hole of the test stand. Further, a hammer is swingably provided such that its pivot point is located on the axis O above the spark plug. The position of the hammer is determined such that when the hammer is allowed to free fall swing after the lifted end of the hammer is released, the end of the hammer collides with the insulator of the spark plug at a position about 1 mm away from the rear end thereof (to which the metallic terminal member is attached). The end of the hammer is caused to collide with the insulator, while the lift angle of the hammer (the angle in relation to the direction of the axis O) is increased in increments of a predetermined angle. This operation is repeated, and the fracture energy is obtained on the basis of the lift angle at which the insulator is broken.

In Examples 1 to 3, the Vickers hardnesses Hv of the packing and the metallic shell were measured in accordance with the method defined in JIS:Z2244 (2003). For the measurement, a Vickers hardness tester conforming to JIS:B7725 (1997) was used, and the test load was set to 2 N.

EXAMPLE 1

First, a test was performed for determining the relationship between the hardness of the first packing and the insulator fracture energy. Spark plugs including packings of differing hardness were manufactured as test samples. The Charpy test was performed for each test sample, and the insulator fracture energy was determined. The spark plugs used in this test were configured such that the area of the axial cross section of the insulator was 37 $mm^2$, the crimp portion of the metallic shell had a hardness of 180 Hv, the difference between the inner diameter E of the tool engagement portion of the metallic shell and the outer diameter G of the first packing was zero; that is, neither play nor talc was present between the two members.

The test results show that the insulator fracture energies of nine test samples respectively, including packings having a hardnesses of "100," "120," "140," "160," "180," "200," "220," "240" and "260" (Hv) were "0.52," "0.49," "0.43," "0.34," "0.25," "0.2," "0.18," "0.17" and "0.17" (J). When a graph of FIG. 5 showing these results was drawn, the present inventors found that the insulator fracture energy is higher and the insulator is less likely to fracture when the hardness of the first packing is lower than 180 Hv (the hardness of the crimp portion), as compared with the case (indicated by a black triangle in the graph) where the hardness of the first packing is 180 Hv (the hardness of the crimp portion). That is, the present inventors found that the hardness N of the first packing is desirably set lower than the hardness of the metallic shell, in particular, the hardness M of the crimp portion.

EXAMPLE 2

Next, a test was performed for determining the relationship between the difference (play) between the diameter of the inner circumferential surface of the metallic shell (the diameter E in FIG. 2) and the outer diameter of the first packing (the diameter G in FIG. 2), and the insulator fracture energy. Spark plugs including first packings having a fixed inner diameter and differing outer diameters (that is, packings identical in terms of inner diameter of the annular portion but which differ in cross sectional area) were manufactured as test samples. The Charpy test was performed for each test sample, and the respective insulator fracture energies were determined. The spark plugs used in this test were configured such that the area of the axial cross section of the insulator was 37 $mm^2$, the hardness of the crimp portion of the metallic shell was 180 Hv, and the hardness of the first packing was 120 Hv.

The test results show that the insulator fracture energies of seven test samples in which the respective differences between the diameter of the inner circumferential surface of the metallic shell and the outer diameter of the first packing were set to "0," "0.05," "0.1," "0.2," "0.3," "0.4" and "0.5" (mm) were "0.49," "0.5," "0.56," "0.59," "0.59," "0.59" and "0.59" (J), respectively. When a graph of FIG. 6 showing the results was drawn, the present inventors found that when the diameter difference is 0.1 mm or greater, the insulator fracture energy becomes generally constant. Also, the fracture energy is higher and the insulator becomes less likely to fracture, as compared with the case where the diameter difference is less than 0.1 mm. That is, the present inventors found that when the play between the inner circumferential surface of the metallic shell and the first packing (the inner diameter E of the metallic shell—the outer diameter G of the first packing) is 0.1 mm or greater, the first packing can absorb an external impact, while slightly changing its position, so that the insulator becomes less likely to fracture. The difference between the diameter of the inner circumferential surface of the metallic shell and the outer diameter of the first packing is preferably set to 1.0 mm or less, more preferably, 0.5 mm or less.

EXAMPLE 3

Next, a test was performed for determining the relationship between the area of the axial cross section of the trunk portion of the insulator and the ratio in insulator fracture energy between the case where the first packing is provided and the case where the first packing is not provided. Four types of insulators having differing axial cross sectional areas were prepared. A first type of test sample in which the minimum diameter portion of the crimp portion is brought into contact with the trunk portion of the insulator and a second type of test sample in which the crimp portion does not contact the trunk portion of the insulator but where the first packing is brought into contact with the trunk portion were manufactured using each type of insulator. The Charpy test was carried out for each test sample, and the respective insulator fracture energies were determined. The spark plugs used in this test were configured such that the crimp portion of the metallic shell had a hardness of 180 Hv, the first packing had a hardness of 140 Hv, and the difference between the inner diameter E of the tool engagement portion of the metallic shell and the outer diameter G of the first packing was set to zero; that is, neither play nor talc was present between the two members.

The test results show that of the two types of test samples including the insulator in which the area of the axial cross section was 101 $mm^2$, the test sample in which the crimp portion was brought into contact with the trunk portion of the insulator exhibited an insulator fracture energy of 1.46 J, and the test sample in which the packing, rather than the crimp portion, was brought into contact with the trunk portion of the insulator exhibited an insulator fracture energy of 1.31 J. The ratio of insulator fracture energy between the case where the crimp portion contacted the trunk portion to the case where the first packing contacted the trunk portion was 1.11. Similarly, of the test samples including the insulator in which the area of the axial cross section was 75, 60 or 37 $mm^2$, the test sample in which the crimp portion contacted the trunk portion of the insulator exhibited insulator fracture energies of 0.95, 0.7 and 0.43 J, respectively, and the test sample in which the first packing, rather than the crimp portion, contacted the trunk portion of the insulator exhibited insulator fracture energies of 0.85, 0.49 and 0.25 J, respectively. The ratios in insulator fracture energy between the case where the crimp portion contacted the trunk portion to the case where the first packing contacted the trunk portion were 1.12, 1.43 and 1.72, respectively.

The closer the ratio of the fracture energy to 1, the smaller the effect of the presence/absence of the first packing on fracture of the insulator. When a graph of FIG. 7 showing the results was drawn, the present inventors found that in the samples including the insulators having an axial cross sectional area of 75 $mm^2$ or greater, the fracture energy hardly increases as a result of providing the first packing. Because such an insulator has a large axial cross sectional area, the strength of the insulator itself is high. Consequently, even when the crimp portion is brought into contact with the trunk portion, this does not decrease the insulator fracture energy. That is, the present inventors found that the fracture resistance can be improved by providing a first packing in the case where an insulator having an axial cross sectional area of 60 $mm^2$ or less is used.

Figure 8:
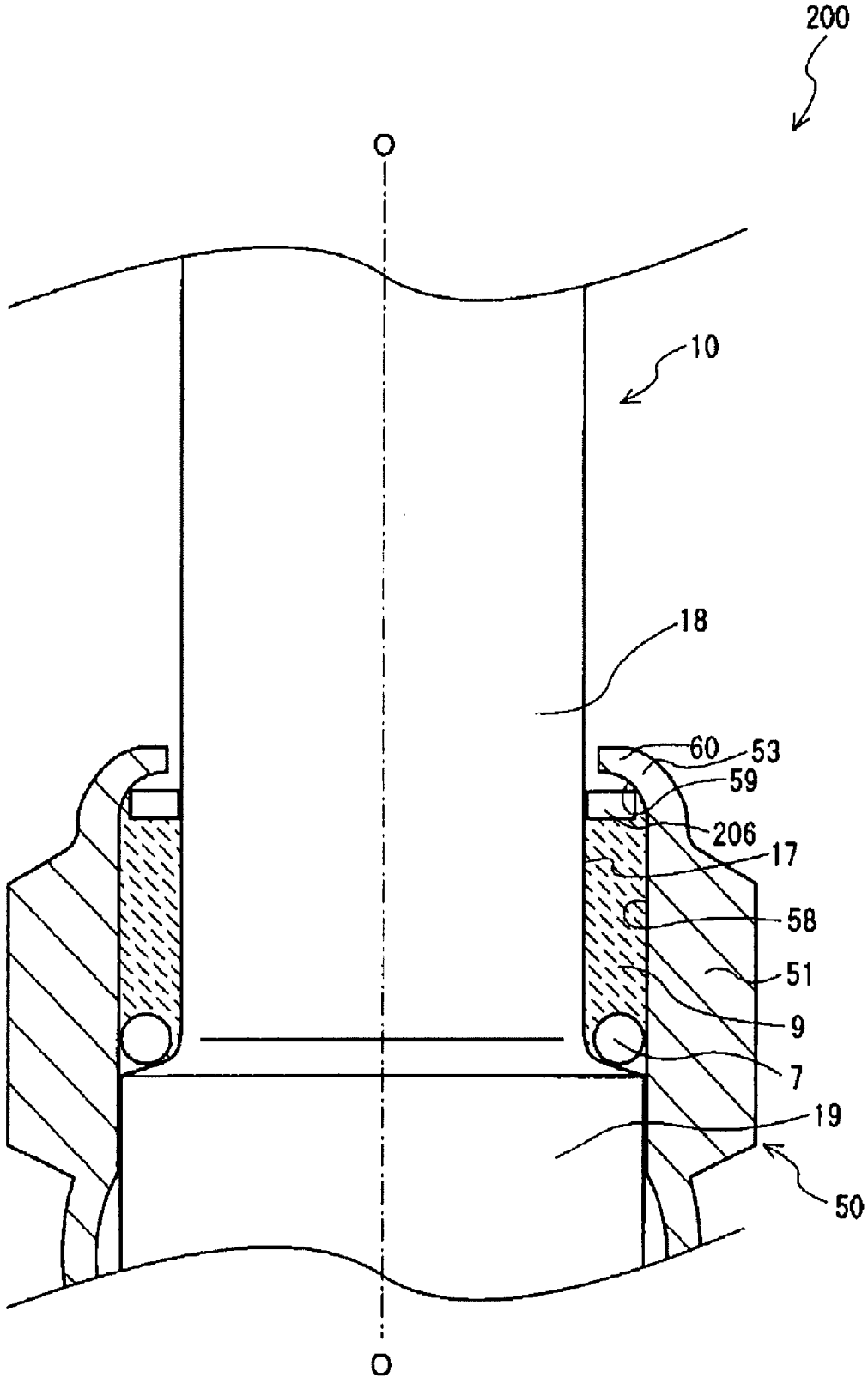
FIG. 8 is a view showing a modification of the cross sectional shape of the packing.

Needless to say, the present invention can be variously modified, while still exhibiting the effects of the invention. For example, in the spark plug 200 shown in FIG. 8, a first packing 206 having a rectangular cross section may be used. Although not shown, the cross sectional shape of the first packing may be elliptical or polygonal, and it is possible to use any packing which assumes an annular shape as in the above-described embodiment and whose outer diameter, inner diameter and hardness satisfy the conditions of the present invention. Further, the first packing need not have a completely annular shape continuously extending throughout its circumference.

Figure 9:
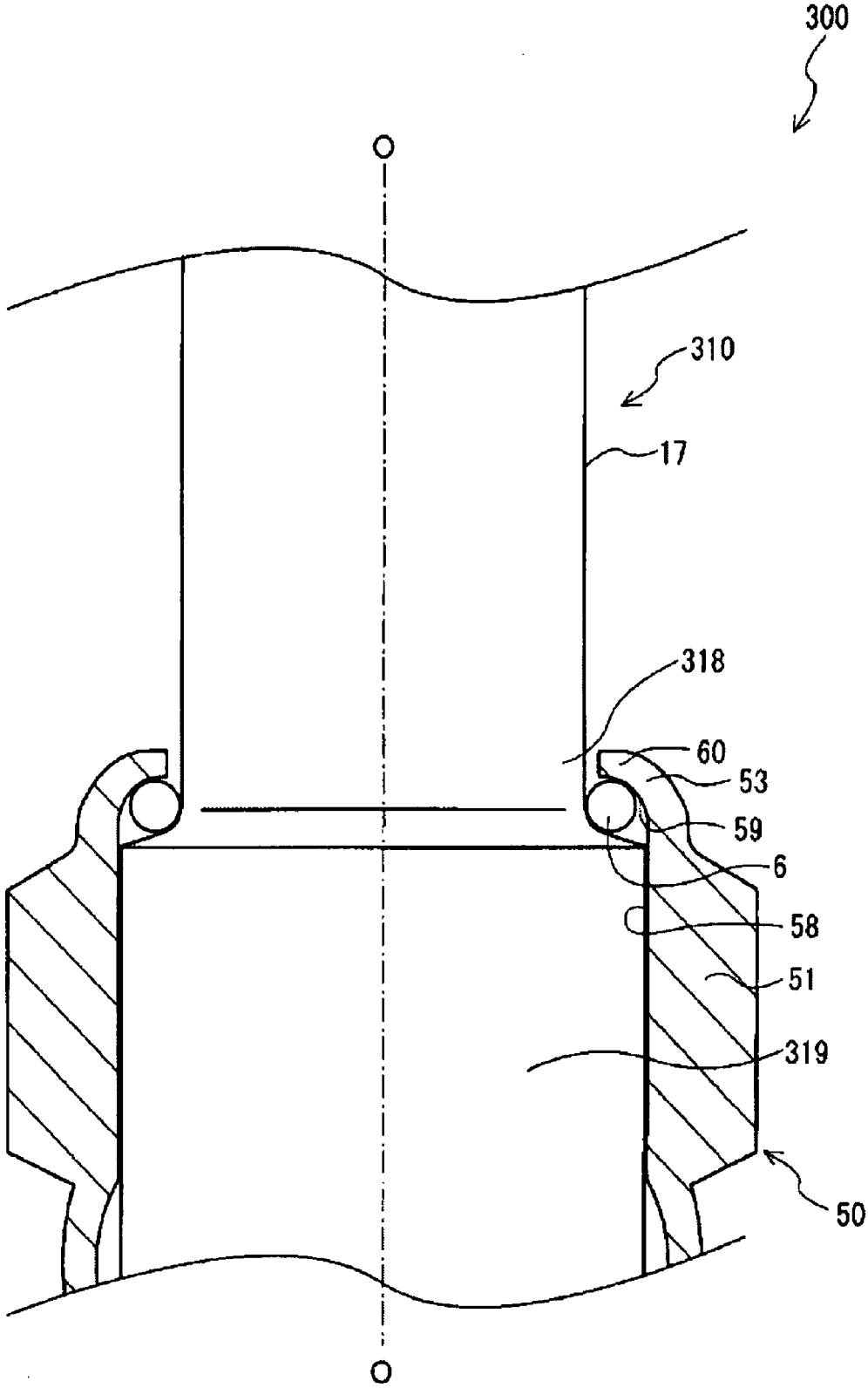
FIG. 9 is a view showing a modification in which sealing by crimping is performed by use of the first packing 6 alone.

Further, the structure of a spark plug 300 shown in FIG. 9 may be employed. In the spark plug 300, a flange portion 319 of an insulator 310 is extended rearward, and crimping is performed in a state in which only the first packing 6 is disposed between the crimp portion 53 and a trunk portion 318, whereby a seal is provided between the metallic shell 50 and the insulator 310.

INDUSTRIAL APPLICABILITY

The present invention can be applied to cases where a ceramic substrate such as insulator and a metallic shell are fixed together in a spark plug, a temperature sensor, a gas sensor, or the like.

It should further be apparent to those skilled in the art that various changes in form and detail of the invention as shown and described above may be made. It is intended that such changes be included within the spirit and scope of the claims appended hereto.

This application is based on Japanese Patent Application No. 2004-278031 filed Mar. 13, 2003 and U.S. Provisional Application No. 60/885,783 filed Jan. 19, 2007, the above-noted applications incorporated herein by reference in their entirety.

What is claimed is:

1. A spark plug comprising:

a rod-shaped center electrode having an electrode for spark discharge at a front end thereof;

an insulator which has an axial hole extending along the direction of an axis of the center electrode and which holds the center electrode in the axial hole;

a metallic shell surrounding the insulator, the metallic shell holding a trunk portion of the insulator by a crimp portion provided at a rear end of the metallic shell in a state in which the insulator engages a step portion formed on an inner circumferential surface of the metallic shell; and an annular first packing disposed between an inner circumferential surface of the crimp portion and an outer circumferential surface of the trunk portion, wherein the following relationship is satisfied:

$$(G+L)/2 \geqq d > L$$

where G represents an outer diameter in millimeters of the first packing, L represents an inner diameter in millimeters of the first packing, d represents an inner diameter in millimeters of a minimum diameter portion of the crimp portion, and wherein the following relationship is satisfied:

$$N < M$$

where M represents a hardness in Hv of the crimp portion, and N represents a hardness in Hv of the first packing, wherein the metallic shell has a tool engagement portion on an outer circumferential surface thereof, and the relationship $E-G \geqq 0.1$ (mm) is satisfied, where E represents a diameter in millimeters of a portion of the inner circumferential surface of the metallic shell corresponding to the tool engagement portion.

2. The spark plug according to claim 1, wherein the relationship $J \leqq 60$ ($mm^2$) is satisfied, where J represents an area of a cross section of the insulator perpendicular to the axis thereof measured at a minimum diameter portion of the crimp portion.

3. The spark plug according to claim 1, said insulator having a flange portion located frontward of the trunk portion, and wherein talc is charged in a sealed condition in a clearance formed between the outer circumferential surface of the insulator and the inner circumferential surface of the metallic shell, said clearance extending frontward from the inner circumferential surface of the crimp portion to the flange portion of the insulator.

4. The spark plug according to claim 1, wherein the relationship $(G+L)/2-(G-L)/4 \geqq d$ is satisfied.

5. The spark plug according to claim 1, wherein the relationship $E-G \leqq 1.0$ (mm) is satisfied.

6. The spark plug according to claim 1, wherein the difference between a hardness M (Hv) of the crimp portion and a hardness N (Hv) of the first packing satisfies the relationship $80 \geqq M-N \geqq 20$ (Hv).

7. The spark plug according to claim 1, wherein the first packing has a hardness of 100 to 160 (Hv).

8. The spark plug according to claim 1, further comprising:

an annular second packing disposed between an inner circumferential surface of the metallic shell and an outer circumferential surface of the trunk portion of the insulator, said second packing being located frontward of the first packing; and talc is present between the first and second packings.

9. The spark plug according to claim 8, wherein the relationship $Q-L \geqq 0.1$ (mm) is satisfied, where Q represents an inner diameter in millimeters of the second packing.

10. The spark plug according to claim 9, wherein the relationship $Q-L \geqq 1.0$ (mm) is satisfied.

11. The spark plug according to claim 8, wherein the relationship $P<M$ is satisfied, where P represents a hardness in Hv of the second packing.

12. The spark plug according to claim 8, wherein the relationship $N<P$ is satisfied, where P represents a hardness in Hv of the second packing.

13. The spark plug according to claim 8, wherein the difference between a hardness M (Hv) of the crimp portion and a hardness P (Hv) of the second packing satisfies the relationship $80 \geqq M-P \geqq 20$ (Hv).

14. The spark plug according to claim 8, wherein the metallic shell includes a tool engagement portion formed on an outer circumferential surface thereof; and the relationship Q−L>E−G (mm) is satisfied, where E represents an inner diameter in millimeters of a portion of the inner circumferential surface of the metallic shell corresponding to the tool engagement portion, and Q represents an inner diameter in millimeters of the second packing.

* * * * *